US005430987A

United States Patent [19]

Lane, Jr. et al.

[11] Patent Number: 5,430,987

[45] Date of Patent: Jul. 11, 1995

[54] TOOLING TO FORM TEAR-OFF STRIP ON A DISPENSER POUCH

[75] Inventors: William A. Lane, Jr., Lake Arrowhead; Steven D. Davis, Yuciappa, both of Calif.

[73] Assignee: W. A. Lane, Inc., San Bernardino, Calif.

[21] Appl. No.: 151,549

[22] Filed: Nov. 12, 1993

Related U.S. Application Data

[63] Continuation of Ser. No. 10,766, Jan. 24, 1993.

[51] Int. Cl.[6] ..... B65R 9/06; B65R 61/06; B65R 61/18

[52] U.S. Cl. ..... 53/133.8; 53/555; 493/363; 493/930

[58] Field of Search ..... 53/555, 554, 552, 451, 53/133.8, 133.3; 83/678; 493/930, 364, 363, 230, 238, 209

[56] References Cited

U.S. PATENT DOCUMENTS

| | | | |
|---|---|---|---|
| 3,210,908 | 10/1965 | Samberg | 53/555 X |
| 3,234,069 | 2/1966 | Saas | 53/133.8 X |
| 4,631,905 | 12/1986 | Maloney | 53/554 |
| 4,682,976 | 7/1987 | Martin et al. | 53/133.8 |
| 4,861,414 | 8/1989 | Vogan | 493/930 X |
| 5,284,002 | 2/1994 | Fowler et al. | 53/133.8 X |

*Primary Examiner*—James F. Coan
*Attorney, Agent, or Firm*—James G. O'Neill

[57] ABSTRACT

An enlarged dispensing pouch for holding viscous food product for dispensing from a specific hand held or similar type dispenser, is formed so as to include a tear strip which will accurately and consistently open a funnel-shaped, centrally disposed outlet spout formed in the pouch. The tooling to form the tear-off strip across the pouch and up to the outlet spout includes a plurality of blade groupings having specifically sized and shaped blades to form a predetermined number of enlarged perforations and smaller end perforations along the tearline of pouches to enable the tear strips so formed to be accurately and consistently torn off the pouches.

7 Claims, 2 Drawing Sheets

TOOLING TO FORM TEAR-OFF STRIP ON A DISPENSER POUCH

CROSS REFERENCE TO RELATED APPLICATIONS

This application is a continuing application of applicants' application entitled DISPENSER POUCH AND TOOLING FOR MAKING, Ser. No. 08/010,766, filed Jan. 29, 1993, and also assigned to W. A. Lane, Inc.

BACKGROUND OF THE INVENTION

1. Field of the Invention

This invention relates generally to pouches for holding liquified or pulverized products, and more particularly, to an improved pouch and tooling for making a novel tear-off strip in such pouches.

2. Description of Related Art

As described in applicant's copending application Ser. No. 08/010,766, referred to above, the entire contents of which are incorporated herein by this reference thereto, film pouch forming, filling and sealing machines, are now being widely used to package food and related products in flexible film pouches for ready dispensing of such products from hand held and other dispensers.

As further described in this copending application, the novel head seal means thereof includes, among other things, cut-off or severing means and a multi-bladed perforator to form pouches with tear-off strips in form, fill and seal machines from rolls of film in a continuous process. However, as discussed in more detail below, the head seal means and the multi-bladed perforator disclosed therein, do not always work as required.

In known smaller pouches formed on a form, fill and seal pouch packaging machine, tear-off strips may be formed by a means which perforates or weakens a plurality of small predetermined portions of the pouches. Furthermore, as disclosed in applicants' copending application, an outlet spout or dispensing opening in such larger pouches, has no such perforations formed thereacross.

In use, it has been found that tear-off strips having a large number of small perforations or weakened portions, work well when used with smaller pouches. However, it has been discovered that in larger pouches, such as disclosed in applicants' copending application, containing a substantially large amount of food product, and having an outlet spout or other opening formed in the dispensing end thereof, tear-strips having a large number of small perforations or weakened portions do not produce consistent, reliable results. That is, even tearlines are not consistently obtained when such tear-strips are removed from larger pouches. This uneven tearline, may cause damage to the pouch, or the outlet spout of the pouch may improperly or poorly dispense the product. Furthermore, if an uneven tearline is formed across the outlet spout when the tear-strip is removed, improper sealing of this outlet spout in a dispenser may occur.

Through extensive testing, it has been determined that different persons exert or produce a different amount of force when removing tear strips, and, particularly, when removing such strips from substantially large pouches. The weight and volume of the product held in these large pouches expands the larger pouches, including the outlet spout portion, to a far greater degree than may appear in smaller pouches. This expansion, together with the large number of unperforated or unweakened sections formed between the small perforations or weakened portions along the tearline, causes different individuals to apply uneven forces thereto, when they are removing such elongated tear-strips. One of the reasons for this inconsistency in results is that the unperforated or unweakened sections must be torn through one at a time. It has been discovered that different individuals react differently when they tear through the perforated or weakened portions and meet the resistance of each of such unperforated or unweakened portions. For example, people are not consistent, and some individuals tend to pull harder or exert more force, while others tend to slow down or exert less force, each time they meet substantially no resistance, or when they meet resistance in removing tear strips. Furthermore, all individuals tend to apply different forces in pulling off tear strips, depending on the time of day and/or how they feel when removing the same. This difference in force applied, causes a jerky or uneven pull along the tearline, producing inconsistent and unreliable results.

It has now been discovered that to produce the best results and, therefore, an even tearline, when removing tear-strips, particularly across an outlet spout that may be formed through an elongated tear-strip, a consistent force should be quickly applied, with no increases and/or hesitations or let up in force applied. This fast, consistent application of force quickly removes the strip, and leaves a smooth tearline. There, therefore, exists the need for an improved large pouch having an easily and consistently torn-off tear-strip which leaves a clean or substantially even tearline, and for improved tooling to make such a tear-strip on a large pouch.

SUMMARY OF THE INVENTION

Accordingly, it is a general object of the present invention to provide an improved collapsible, sanitary dispensing pouch. It is a more particular object of the present invention to provide an improved collapsible dispensing pouch having a tear-off strip that may be consistently and reliably removed. It is a further object of the present invention to provide a collapsible dispensing pouch having a tear-off strip that lends itself to being easily removed in a faster and more consistent manner. It is yet another object of the present invention to provide a collapsible dispensing pouch with an integral spout for controlled dispensing of product from the spout, after removal of a novel tear-off strip. It is a still further object of the present invention to provide a novel tear-off strip forming means to form a plurality of novel tear-off strips on specifically configured pouches for use in a dispenser.

In accordance with the present invention there is provided an enlarged dispensing pouch for holding viscous food product for dispensing. This dispensing pouch is formed so as to include a tear-strip which will accurately, consistently and quickly open a funnel-shaped, centrally disposed outlet spout formed in the pouch. The tooling to form the tear-strip in the enlarged pouch includes specifically sized and shaped blades to form a predetermined number of enlarged perforations in tear-strips to enable such strips to be accurately, consistently and quickly torn-off. The blades of the tooling are guided and supported in an improved head seal which also forms a number of streams of pouches. The perforation forming blades have end and side cutting edges to form a starting portion and a specific number of enlarged perforations across the top of one or more filled pouches, on each side of an outlet spout thereof.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved collapsible, sanitary dispenser pouch of relatively large size, substantially similar to the pouch disclosed in applicants' copending application. The improved pouch includes a novel tear-off strip formed thereon by means of improved head seal tooling including a novel perforation forming blade means guided in the head seal. The improved head seal means, also substantially similar to the head seal means disclosed in applicants' copending application, simultaneously forms top and bottom cross seals for a plurality of pouches and cuts-off such formed pouches from moving streams of front and back heat sealable films. Additionally, by use of the improved blade means and modifications to the jaws of the head seal, as described below, the blades of the head seal form an improved tear-off strip on the pouches.

Figure 1:
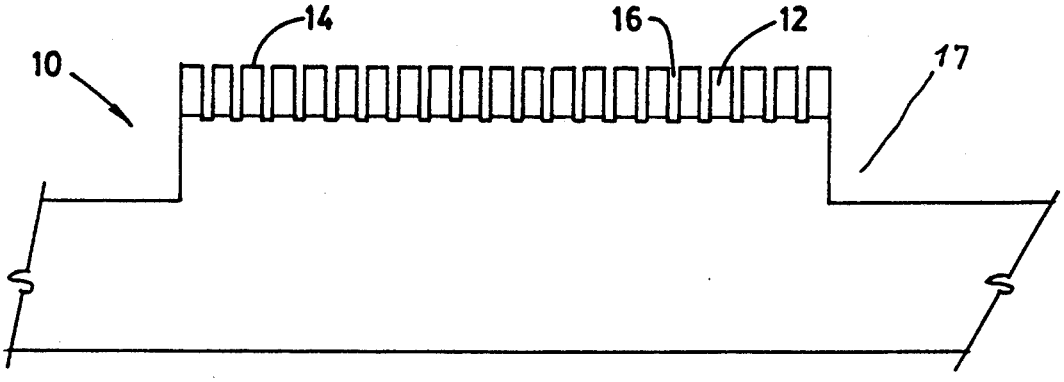
PRIOR ART FIG. 1
FIG. 1 is a front elevational view of a prior art multi-bladed perforator used to perforate enlarged pouches so as to form tear-off strips on a plurality of formed, filled and sealed collapsible dispensing pouch.

FIG. 1 shows a tear-off strip forming blade means 10, of the type generally disclosed in applicants' copending application, having a plurality of small perforation forming blades or tines 12 with angular or sharpened front portions 14, to form tear-off strips. A plurality of small perforations or weakened areas are formed along a tearline when the blade means 10, is forced into contact with one or more formed pouches. The angular or sharpened front portions 14 of the blades or tines 12 are pressed against the pouches to form a plurality of individual perforations or weakened portions along a tearline. Unperforated or unweakened sections are formed by means of spaces 16 between each of the blades 12. These unperforated or unweakened sections must be torn through when the tear-strip is to be removed. A plurality of pouches are formed with tear-strips by including a plurality of such blade means 10 together, with spaces of predetermined size, as indicated at 17, between each blade means. Such spaces 17 would pass over openings or outlet spouts contained in such pouches. This forms a multi-bladed perforator having spaces between each blade set 10.

However, because of the large number of small perforations formed by such blade means 10 in large pouches, problems arise for many individuals when they attempt to remove the formed tear-strips to dispense product contained therein. Such problems are compounded when there are a plurality of such small perforations on either side of an outlet opening or spout.

Figure 2:
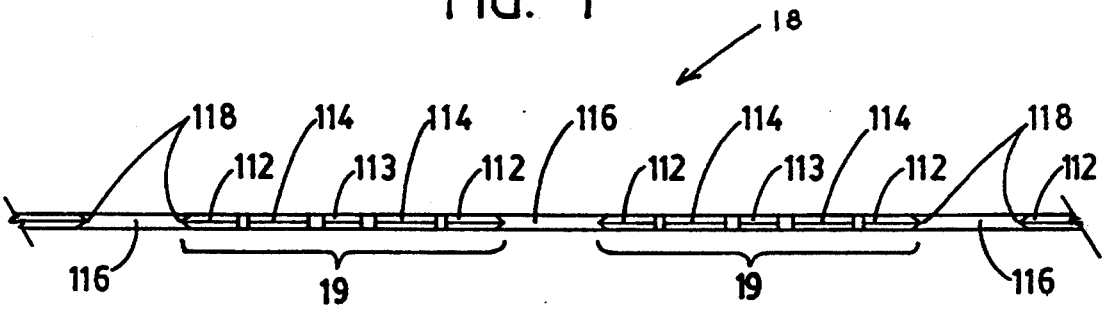
FIG. 2 is an end view, looking toward the cutting edges of the perforation blades, of a tear-off strip forming blade means in accordance with the present invention.
Figure 3:
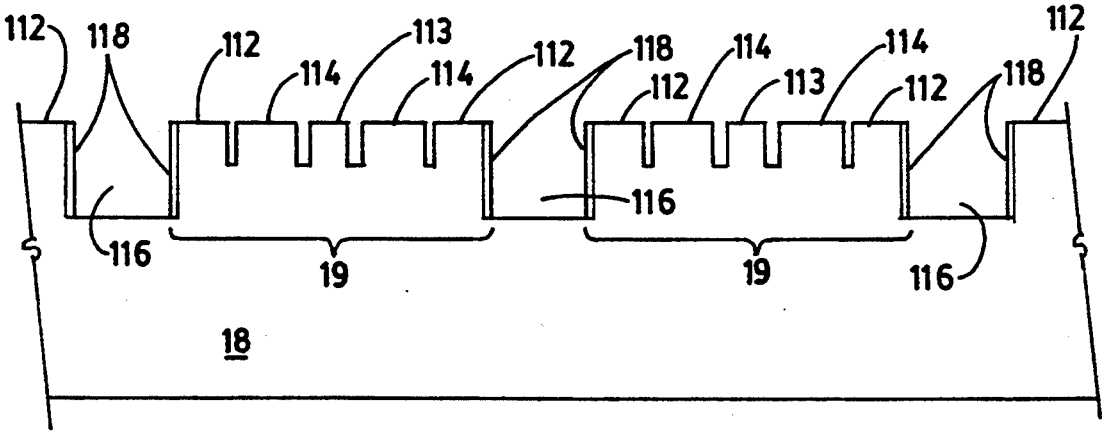
FIG. 3 is a top elevational view of the tear-off strip forming blade means of FIG. 2.
Figure 4:
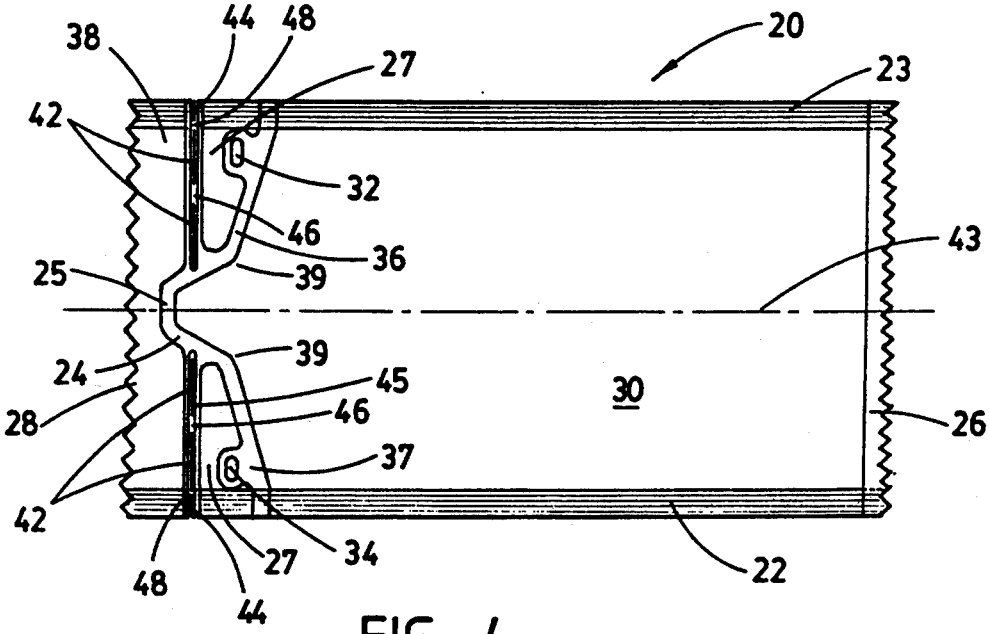
FIG. 4 is a front elevational view of an improved pouch having a tear-off strip formed thereon by the tear-off strip forming blade means of FIG. 2.

FIGS. 2 and 3 hereof, show a novel and improved multi-bladed means 18 to form improved tear-strips on collapsible, sanitary dispenser pouches, such as pouch 20 shown in FIG. 4, in accordance with the present invention. The pouch 20 has a pair of side seals 22, 23 and a centrally disposed outlet spout 24, having a removable or tear-off tip 25, formed in a cross seal at the outlet end 28 thereof, between the side seals 22, 23. Additionally, the pouch 20 includes a bottom cross seal 26 and at least one top or upper cross seal. A first or single top cross seal may be formed by the sealed edge of outlet spout 24 and further angularly descending seal means 36 and 37. A further top cross seal may also be provided at the furthest point on the outlet end 28.

An inner chamber 30, is formed in the pouch 20, between the side seals 22 and 23, bottom cross seal 26, and the first cross seal means formed by the centrally disposed outlet spout 24 and the angular seal means 36 and 37. A relatively large amount of viscous food product, such as 24 to 30 fluid ounces (71 to 89 cl), is placed in and sealingly held in this chamber 30, for dispensing through the opening formed in the centrally disposed outlet spout 24, when the pouch is held in a dispenser and the end or tip 25 opened or removed, as described below. A pair of alignment/holding openings 32, 34, are formed extending entirely through both sheets of heat sealed film forming the pouch 20, adjacent the angular seal means 36 and 37, in a substantially flat area 27, on either side of the sealed outlet spout 24, outside or away from the interior chamber 30, adjacent the side seals 22, 23, and below a tear-off strip 38, described below. These alignment/holding openings 32, 34 are accurately formed in predetermined positions, to hold the filled pouch in a dispensing means.

The tear-off strip 38 of pouch 20 includes relatively few cuts or perforations 42, 44 formed along a tearline 45. In the preferred embodiment disclosed herein, there are two substantially equal length, enlarged cuts or perforations 42 on each side of the outlet spout 24 and a smaller, starting or ending cut or perforation 44 at the ends of the tearline 45, in the side seals 22 and 23. As described in more detail below, these cuts 42, 44 combine to enable the tear-off strip 38 to be consistently and reliably removed, by an easy and quick pull thereon by an individual. This easy and quick pull removes the tear strip 38 including the tip or farther end 25 of outlet spout 24. With tip 25 removed the outlet spout 24 is opened for dispensing of product in chamber 30, from the pouch. The two enlarged cuts 42 formed on either side of the outlet spout 24 extend across substantially the entire outlet end, starting adjacent the outlet spout 24, except for small uncut or unperforated portions 46 between each of the pairs of cuts 42, and further uncut or unperforated portions 48 adjacent each of the ending or starting cuts 44. These cuts (42, 44) and the uncut portions (46, 48) are designed so as to allow a tear-off strip 38 to be quickly removed, in a smooth, consistent and reliable manner, by all persons. Therefore, when the tear-off strip 38 is removed, the end or tip 25 of outlet 24 is also smoothly removed to form the desired opening for dispensing the viscous contents of the pouch.

The pouch 20 must be made from material which will remain sanitary and is sufficiently flexible to enable the pouch to be collapsed by various operating means in dispensing means, so as to substantially completely empty the contents therefrom. Such pouch forming materials are now readily available and used in the food industry. Furthermore, although the pouch may be formed in various sizes and shapes, it is preferably formed so as to be substantially rectangular in shape in the x-y dimensions, as shown in FIG. 4, and substantially elliptical (when filled) with narrowed or pointed ends in the z dimension. As discussed above, this elliptical shape is produced by the amount and weight of the product held in the pouch, and causes some of the problems with the prior tear-off strip.

A plurality of pouches 20 are formed in a form, fill and sealing machine, as disclosed in applicants' copending application. Such larger pouches have widths of between 5 and 6 inches (127 to 152.5 mm), and any desired length, such as 12 inches (305 mm), so that up to four pouches may be simultaneously formed, filled and sealed when using 24 inch (610 mm) film rolls in the machine.

The novel head seal tooling disclosed in applicants' copending application is used herein, except that the multi-bladed perforator forming means is replace by the blade means 18 disclosed herein, and the openings in the jaws of the head seal are elongated, as described below.

Figure 5:
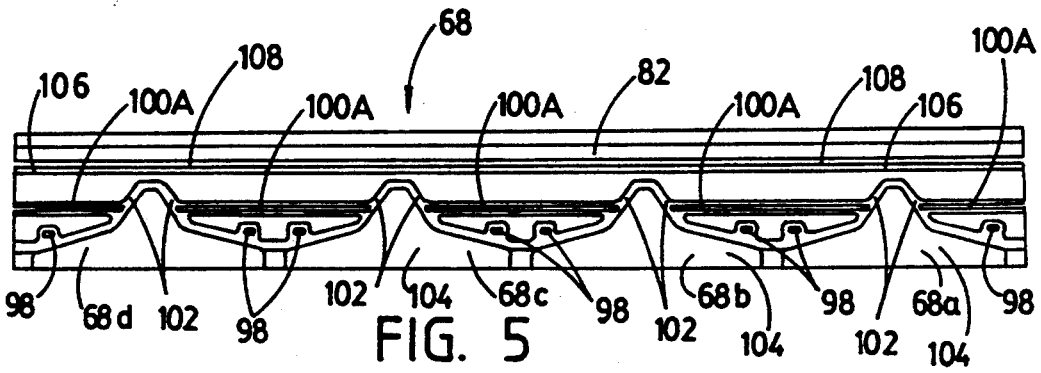
FIG. 5 is a front elevational view of one of the jaws of an improved head seal containing the tear-off strip forming blade means of FIG. 2.
Figure 6:
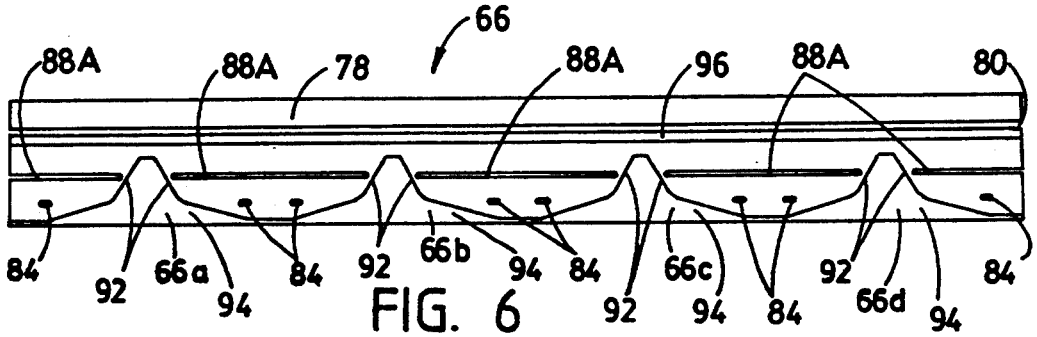
FIG. 6 is a front elevational view of the other jaw of the improved head seal containing the tear-off strip forming blade means of FIG. 2.

Turning now to FIGS. 5 and 6, there shown are separate jaws 66 and 68 of the tooling to form the pouches 20. These jaws are substantially similar to and are used in the exact same manner as disclosed in applicants' copending application. As shown in FIG. 6, the front surface of the jaw 66 has, by way of example only, and not by way of limitation, four pouch forming areas, marked as 66*a*, 66*b*, 66*c* and 66*d*, to form four separate pouches at a time, when they are brought into contact with four corresponding areas 68*a*, 68*b*, 68*c* and 68*d* on the front surface of jaw 68. Above these areas 66*a–d* on jaw 66 are a cross seal portion 78, and a cut-off receiving area or depression 80, each of which extend along the entire face thereof. The cross seal portion 78 coacts with a corresponding cross seal portion 82 extending across the entire front face of jaw 68 to form the bottom seal 26 of a top, partially formed pouch (side seals only), when the jaws 66 and 68 are brought together, before filling and completion of a top pouch, as described more fully below.

Each of the areas 66*a–d* on the front surface of jaw 66 includes the following elements to form the top cross seal having outlet spout 24 and angular seal means 36 and 37, openings 32 and 34, the cuts or perforations 42, 44, and, if desired, a further top cross seal adjacent end 28, in a completed and filled pouch 20: a pair of openings 84 through which punches are reciprocated to form the openings 32 and 34 in the pouch; elongated, slotted openings 88A through which the multi-bladed perforator 18 slides to form the cuts 42 and 44; a raised, substantially funnel or hat-shaped, combination outlet and angular seal means forming edge or surface 92, surrounding an insulated area 94; and if a further top cross seal is desired adjacent end 28, a further seal forming area 96, which preferably extends entirely across the face or front surface of jaw 66.

As shown in FIG. 5, each of the corresponding areas 68*a–d* on the front surface of jaw 68 includes the following elements which cooperate with the respective or corresponding elements on the front surface of jaw 66 to enable the tooling to form the outlet spout 24, angular seal means 36 and 37, openings 32 and 34, the cuts or perforations 42, 44, to cut-off a completed filled and sealed pouch 20, and if used, to form the further top cross seal: a pair of recessed holes 98 to receive the ends of punches when they are reciprocated to form the openings 32 and 34, after they pass through the sheets of film; elongated, slotted recesses 100A to receive the ends of improved blades 112, 113 and 114 of perforator blade means 18, described below, when the blades 112, 113 and 114 form the cuts 42, 44; a raised complementary surface 102, surrounding an insulated area 104, against which the funnel or hat-shaped, combination outlet spout forming and angular seal means forming edge 92 of the front surface of jaw 66 presses the front and rear films film, and, if the further top cross seal is to be added and the further seal forming area 96 is located on each of the areas 66*a–d* on front jaw 66, a further surface 106 against which the further seal forming area 96 presses the front and rear films. Furthermore, an elongated opening 108 is formed through the jaw 68, across from and cooperating with the recess 80 formed in the jaw 66. A cut-off means, such as a cut-off blade (not shown), reciprocates in opening 108 to cut-off formed pouches 20 when the cut-off blade passes through the front and rear films into recess 80.

During operation of the head seal, the jaws 66 and 68 are first brought together to form the various seals by heat and pressure. Then, the punches, perforation blade means 18 and cut-off blade, are operated, as disclosed in applicants' copending application. The perforation means 18 includes the plurality of blades 112, 113 and 114 with openings or spaces 116 formed therebetween, that are repeated so as to form groups 19, as often as needed to form the number of pouches desired. In this manner, the blades 112, 113 and 114 form the 2 cuts 44 on each side of the spout, while the blades 113 span two adjacent streams of pouches (slit from each other, as explained above), to form an ending/starting cut 44 at the ends of the tearline 45, on each pouch. That is, if four pouches are to be formed, the blade means 18 will include three full groups 19 and two partial (or end) blade groupings 19 which reciprocate in the elongated slots 88A, on either side of the areas to form the outlet spouts 24, and operate as follows to form the unique cuts 42, 44 in each of the improved pouch 20:

Each group 19, whether complete or partial, of the multi-bladed blade means 18, actually forms the openings on adjacent sides of separate pouches or only on one side of a pouch at either end of the head means when the multi-bladed blade means 18 is reciprocated in the elongated slots 80A to contact and perforate (cut) specific areas of pouches 20 along tearlines 45. That is, there are two substantially equal length, elongated cuts 42 formed on each side of an outlet opening 24 (spanned by the space 116) and two ending or starting cuts 44 at the far ends of the tearline 45 of each pouch. After passing through the pouches along the tearline 45, the respective grouping of blades enter into the opposite elongated openings 100A. As shown in FIGS. 5 and 6, the elongated openings 88A extend up to and closely adjacent to the hat shaped portions on jaw 66, while the elongated openings 100A extend up to and partially into the raised complementary surface 102 on jaw 68. Furthermore, when passing through the pouch material along the tearline 45 each of the edges of a blade 112, adjacent to and extending toward a space 116, are provided with sharpened edges 118 so as to accurately cut the material in a cut 42, along the tearline 45 adjacent each side of the formed outlet spouts 24 so as to be as close as possible to the formed outlet spout 24, without rupturing or penetrating the same.

The formed elongated cuts 42 on each side of the outlet spout 24 of a pouch enable an individual opening the pouch to quickly remove the tear-strip 38 after starting at one end cut 44. This is aided by the sharp end cuts made by sharpened edges 118 close to the outlet spout 24, when an individual removing the tear-strip 38 approaches and leaves the outlet spout. That is, by providing a small starting cut 44 and/or ending cut 44, depending on which way the tear-off strip 38 is pulled to be removed, and the two intermediate, elongated cuts 42 up to as close as determined possible to the outlet spout 24, an individual removing the tear-strip 38 will be forced to exert a consistent, reliable force, quickly along the tearline. The tearline is formed quickly since both the small uncut area 46 and the larger uncut areas 48 between the cuts 44 and 42 will cause any force applied thereto, when tearing through the same, to be quickly and easily transferred to the next area to be torn, along the substantially long open or cut areas 42 until the tear-strip is removed. Thus, the jerky, non-smooth tearing of known tear-strips is eliminated and a smooth tearline is consistently provided.

It, therefore, can be seen that the uniquely sized and shaped perforator blade means 18 acting with the modified tooling jaws of the present invention allow unique tear-strips to be formed on enlarged collapsible dispenser pouches. Furthermore, the unique pouches, having such tear-strips formed thereon, allow such pouches to be easily and quickly opened in a consistent and reliable manner by various individuals to allow sanitary food and other viscous products to be quickly and easily dispensed from such pouches in a consistent manner.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A head seal means adapted to be mounted to a form, fill and seal pouch packaging machine comprising first and second opposed elongated jaws; each of said first and second opposed elongated jaws have a front surface and a rear surface, with each front surface including heating means and means for forming top and bottom cross seals on heat sealable films passing therebetween on a plurality of pouches; said front surface of said first opposed elongated jaw including a plurality of pouch forming areas for forming separate substantially large pouches when said pouch forming areas are brought into contact, against said heat sealable films, with corresponding areas on said front surface of said second opposed elongated jaw; and said front surface of said first opposed elongated jaw including an elongated cross seal portion and an elongated cut-off receiving recess extending along the entire length thereof; said cross seal portion coacting with said heat sealable films and a corresponding elongated cross seal portion extending along the entire length of said front surface of said second jaw to form bottom seals on a first, partially formed pouch, when said front surfaces of first and second jaws are brought together, before filling and completion of said first, partially formed pouch; and including, in each of the corresponding pouch forming areas on said front surface of said second opposed elongated jaw, the following: a pair of recessed holes to receive the ends of punches when they are reciprocated to form said openings in said second pouch; a pair of slotted recess to receive the ends of a multi-bladed perforator, when said multi-bladed perforator form perforations for a tear-off strip in said second pouch; and a raised surface surrounding an insulated area against which said raised, combination outlet spout and angularly aligned seal forming portions surrounding an insulated area on said front surface of said first jaw presses said heat sealable films to form an outlet spout and angularly aligned seal forming portions on said second pouch; the improvement comprising:

said multi-bladed perforator which slides in said pair of elongated, slotted openings having blades sized and dimensioned to form a plurality of cuts on said second pouch on each side of said outlet spout, which cuts extend substantially across said second pouch, immediately up to, but not across a tip of said outlet spout.

2. The head seal means of claim 1, further including, in each of said corresponding pouch forming areas on said front surface of said second opposed elongated jaw, the following: an elongated opening formed through said second jaw across from and cooperating with said elongated recess formed in said front surface of said first opposed elongated jaw; and a cut-off blade, reciprocally mounted in said elongated opening in said second opposed elongated jaw to cut-off said second pouch when said cut-off blade passes through said heat sealed films into said elongated recess in said first surface of said first opposed elongated jaw to thereby sever said second pouch from said first pouch.

3. The head seal means of claim 2, further including operating means for said plurality of punches, said multi-bladed perforator and said cut-off blade.

4. A multi-bladed perforator means for a head seal means adapted to be mounted to a form, fill and seal pouch packaging machine; said head means comprising first and second opposed elongated jaws to form a tear-off strip on a plurality of collapsible dispenser pouches, along a tearline having two ends on each side of an outlet spout formed in each of the pouches; the improvement comprising:

a plurality of blade groupings on said multi-bladed perforator means;

a plurality of spaces formed between each of said blade groupings;

said blade groupings being operable by actuation means to reciprocate in elongated slots in said head means to form a plurality of cuts on adjacent sides of said collapsible dispenser pouches along the tearlines thereof; and each of said plurality of blade groupings on said multi-bladed perforator means being broken down into a full blade grouping and a half blade grouping, with each of said full groupings being sized so as to form two substantially equal length, elongated cuts on each side of the outlet opening and two end cuts, substantially smaller than said elongated cuts, on said tearline of a collapsible dispenser pouch.

5. The multi-bladed perforator means for a head seal of claim 4 wherein each of said full blade groupings includes five (5) blades, four blades of which are substantially equal in length and the fifth blade of which is smaller than the four blades and substantially centrally located in each of said full blade groupings between said four blades.

6. The multi-bladed perforator means for a head seal of claim 5 wherein said multi-blade perforator means has two ends with two half blade groupings placed at said two ends, each of said half blade groupings including only three (3) blades, two blades of which are substantially equal in length and the third blade of which is smaller than said two blades, and wherein said half blade groupings are sized so as to form two substantially equal length, elongated cuts along a tearline on one side of an outlet opening of a single collapsible dispenser pouch and a single end cut on said tearline on one side of an outlet opening of said single collapsible dispenser pouch.

7. The multi-bladed perforator means for a head seal of claim 6, further including sharpened edges formed on the edges of blades in each grouping adjacent said plurality of spaces formed between each of said blade groupings so as to accurately cut the material along the tearline of said plurality of collapsible dispenser pouches, adjacent each side of the outlet spouts formed therein.

* * * * *